US009777695B2

(12) United States Patent
Itoi et al.

(10) Patent No.: US 9,777,695 B2
(45) Date of Patent: Oct. 3, 2017

(54) HIGH-FREQUENCY DISCHARGE IGNITION DEVICE

(71) Applicant: Mitsubishi Electric Corporation, Tokyo (JP)

(72) Inventors: Naoki Itoi, Tokyo (JP); Hiroshi Okuda, Tokyo (JP); Kimihiko Tanaya, Tokyo (JP)

(73) Assignee: Mitsubishi Electric Corporation, Chiyoda-ku, Tokyo (JP)

( * ) Notice: Subject to any disclaimer, the term of this patent is extended or adjusted under 35 U.S.C. 154(b) by 347 days.

(21) Appl. No.: 14/703,422

(22) Filed: May 4, 2015

(65) Prior Publication Data

US 2016/0138552 A1 May 19, 2016

(30) Foreign Application Priority Data

Nov. 18, 2014 (JP) ..... 2014-233375

(51) Int. Cl.
*F02P 9/00* (2006.01)
*F02P 3/01* (2006.01)
(Continued)

(52) U.S. Cl.
CPC ..... *F02P 9/002* (2013.01); *F02P 3/01* (2013.01); *F02P 17/12* (2013.01); *F02P 23/04* (2013.01);
(Continued)

(58) Field of Classification Search
CPC ..... F02P 9/002; F02P 17/12; F02P 2017/121
See application file for complete search history.

(56) References Cited

U.S. PATENT DOCUMENTS 6,151,954 A * 11/2000 Aoki ..... F02P 17/12 324/378
6,236,213 B1 * 5/2001 Maruta ..... F02P 17/12 324/393
(Continued)

FOREIGN PATENT DOCUMENTS

JP 62-135668 A 6/1987
JP 2013-177881 A 9/2013
(Continued)

OTHER PUBLICATIONS

Communication dated Feb. 2, 2016 from the Japanese Patent Office issued in corresponding Application No. 2014-233375.

*Primary Examiner* — Scott Bauer
(74) *Attorney, Agent, or Firm* — Sughrue Mion, PLLC; Richard C. Turner

(57) ABSTRACT

A high-frequency discharge ignition device includes a current supply device which supplies an AC current to a spark discharge path formed in a gap of an ignition plug, a control device which controls the operation of the current supply device, and a voltage detection device which outputs a signal of a section where a magnetic induction voltage of a primary coil generated after a switch element of an ignition coil device is placed in a shutoff state exceeds a predetermined voltage, and the control device determines the timing when the spark discharge path has been formed in the gap of the ignition plug according to an output signal of the voltage detection device and operates the current supply device based on the timing when the spark discharge path has been formed in the gap of the ignition plug to supply the AC current to the spark discharge path.

8 Claims, 10 Drawing Sheets

(51) Int. Cl.

| | |
|---|---|
| ***F02P 17/12*** | (2006.01) |
| ***F02P 23/04*** | (2006.01) |
| ***H05H 1/24*** | (2006.01) |
| ***H05H 1/46*** | (2006.01) |
| ***H05H 1/52*** | (2006.01) |
| *F02P 15/10* | (2006.01) |

(52) U.S. Cl.
CPC ..... *H05H 1/24* (2013.01); *H05H 1/46* (2013.01); *H05H 1/52* (2013.01); *F02P 15/10* (2013.01); *F02P 2017/121* (2013.01); *H05H 2001/4682* (2013.01)

(56) References Cited

U.S. PATENT DOCUMENTS

| | | | | |
|---|---|---|---|---|
| 6,367,318 | B1 * | 4/2002 | Boyer | F02P 3/0435 73/114.08 |
| 2011/0297131 | A1 * | 12/2011 | Nakano | F02P 9/007 123/596 |
| 2013/0214689 | A1 | 8/2013 | Katsuraya et al. | |
| 2014/0261346 | A1 * | 9/2014 | Tanaya | F02P 3/02 123/594 |
| 2014/0292179 | A1 * | 10/2014 | Katsuraya | F02P 3/01 313/141 |

FOREIGN PATENT DOCUMENTS

| | | | |
|---|---|---|---|
| JP | 5351874 | B2 | 11/2013 |
| JP | 2014-175252 | A | 9/2014 |

* cited by examiner 30
31
31a
31b
V1
V2
I1
20
40
60
61
62
Ia
70
Ibt
10
11
Sig
Vs
50
51
52
53
54
55
56

50
52
53
54
55
56
51
31
31a
31b
30
V1
V2
20
I1
Vs
40
62
61
60
Ie
70
Igt
10
12
11
Sig

HIGH-FREQUENCY DISCHARGE IGNITION DEVICE

BACKGROUND OF THE INVENTION

Field of the Invention

The present invention relates to a high-frequency discharge ignition device which ignites an internal combustion engine by supplying a high-frequency AC current to a spark discharge path and forming discharge plasma in a gap between electrodes of an ignition plug.

Background Art

In recent years, the problems of environmental conservation and fuel depletion have been raised, and in the automobile industry, there is a pressing need to respond to these problems. As an example of the response, a method which remarkably improves the amount of fuel consumption by engine downsizing and reduction in weight using a supercharger is known.

It is known that if a highly supercharged state is reached, the pressure in an engine combustion chamber becomes extremely high in a state not accompanied by combustion, and in this situation, it is difficult to generate spark discharge for starting combustion. One of the reasons is that a required voltage for causing dielectric breakdown between a high-voltage electrode and a GND (ground) electrode of the ignition plug becomes extremely high and exceeds a withstand voltage value of an insulator of the ignition plug.

In order to solve this problem, although studies have been done to increase the withstand voltage of the insulator, it is practically difficult to secure a sufficient withstand voltage as required, and means for narrowing the gap interval of the ignition plug should be provided. However, if the gap of the ignition plug is narrowed, there is a problem in that there is an increasing influence of a flame-out action by the electrode portion, causing degradation of startability and degradation of combustibility.

In order to solve this problem, avoidance means for providing energy greater than heat taken to the electrode portion by the flame-out action using spark discharge or for causing combustion in a part even slightly away from the electrodes is considered. For example, an ignition coil device described in Patent Document 1 has been suggested.

The ignition coil device disclosed in Patent Document generates spark discharge in a gap of an ignition plug by an ignition coil of the related art and supplies a high-frequency AC current to a spark discharge path through a mixer, making it possible to form spark discharge with high energy and discharge plasma spreading in a wider range than normal spark discharge.

[Patent Document 1] Japanese Patent No. 5351874

[Patent Document 2] JP-A-2013-177881

Since the ignition coil device of the related art described in Patent Document 1 supplies the AC current to the spark discharge path, the spark discharge path should be formed.

However, discharge plasma by an excessive AC current promotes electrode wear of the ignition plug, and if the electrodes are worn, the spark discharge gap is widened. When this happens, the discharge voltage of the ignition plug becomes high and exceeds the insulation withstand voltage of the ignition plug, and dielectric breakdown may occur in the ignition plug.

If the discharge voltage of the ignition plug exceeds the high voltage generated by the ignition coil, it is not possible to form the spark discharge path in the ignition plug. For this reason, it is necessary to grasp the discharge voltage of the ignition plug to grasp the discharge state of the ignition plug and the deterioration state of the ignition plug.

According to Patent Document 2, while it is possible to grasp deterioration of the ignition plug to some extent and to find out that the discharge voltage of the ignition plug becomes high, it is not possible to find out that the discharge voltage becomes abnormally low. A special element, such as a Zener diode of a high voltage, is required, and since the element is connected to the secondary coil of a high voltage, an element capable of withstanding a high voltage is required or insulation processing is required, causing a problem in terms of cost.

SUMMARY OF THE INVENTION

The present invention has been accomplished in order to solve the above-described problems in the device of the related art, and an object of the invention is to provide a high-frequency discharge ignition device capable of grasping whether a discharge voltage of an ignition plug is too high or too low using means without increasing cost, supplying an AC current to a spark discharge path according to the discharge state of the ignition plug, and efficiently forming discharge plasma.

A high-frequency discharge ignition device according to an aspect of the present invention includes: an ignition coil device which has an ignition coil unit having a magnetically coupled primary coil and secondary coil, and a switch element conducting the current of the primary coil and shutting off the current after the conduction, when the switch element is placed in a conduction state, flows a current in the primary coil to generate and accumulate a magnetic flux, when the switch element is placed in a shutoff state, generates a predetermined high voltage in the secondary coil, and supplies the generated predetermined high voltage to an ignition plug, which generates a spark discharge between electrodes with a gap to ignite a combustible air-fuel mixture in a combustion chamber of an internal combustion engine, to form a spark discharge path in the gap; a current supply device which supplies an AC current to the spark discharge path formed in the gap of the ignition plug; a capacitor and an inductor which form a band-pass filter disposed between the ignition plug and the current supply device to prevent the high voltage for forming the spark discharge path from being applied to the current supply device; a control device which controls the operation of the current supply device; and a voltage detection device which outputs a signal of a section where a magnetic induction voltage of the primary coil generated after the switch element is placed in a shutoff state exceeds a predetermined voltage. The control device determines the timing when the spark discharge path has been formed in the gap of the ignition plug according to an output signal of the voltage detection device and operates the current supply device based on the timing when the spark discharge path has been formed in the gap of the ignition plug to supply the AC current to the spark discharge path.

The high-frequency discharge ignition device according to the aspect of the present invention includes the current supply device which supplies the AC current to the spark discharge path formed in the gap of the ignition plug, the control device which controls the operation of the current supply device, and the voltage detection device which outputs the signal of the section where the magnetic induction voltage of the primary coil generated after the switch element of the ignition coil device is placed in the shutoff state exceeds the predetermined voltage. The control device determines the timing when the spark discharge path has been formed in the gap of the ignition plug according to an output signal of the voltage detection device and operates the current supply device based on the timing when the spark discharge path has been formed in the gap of the ignition plug to supply the high-frequency AC current to the spark discharge path. For this reason, it is possible to grasp whether the discharge voltage of the ignition plug is too high or too low using means without increasing cost, to supply the AC current to the spark discharge path according to the discharge state of the ignition plug, and to efficiently form discharge plasma.

The foregoing and other objects, features, aspects, and advantages of the present invention will become more apparent from the following detailed description of the present invention when taken in conjunction with the accompanying drawings.

DETAILED DESCRIPTION OF THE INVENTION

Embodiment 1

A high-frequency discharge ignition device according to Embodiment 1 of the present invention generates spark discharge in a gap of an ignition plug by a high voltage generated by an ignition coil device and supplies an AC current to a spark discharge path, thereby forming a large amount of discharge plasma in the gap of the ignition plug.

Figure 1:
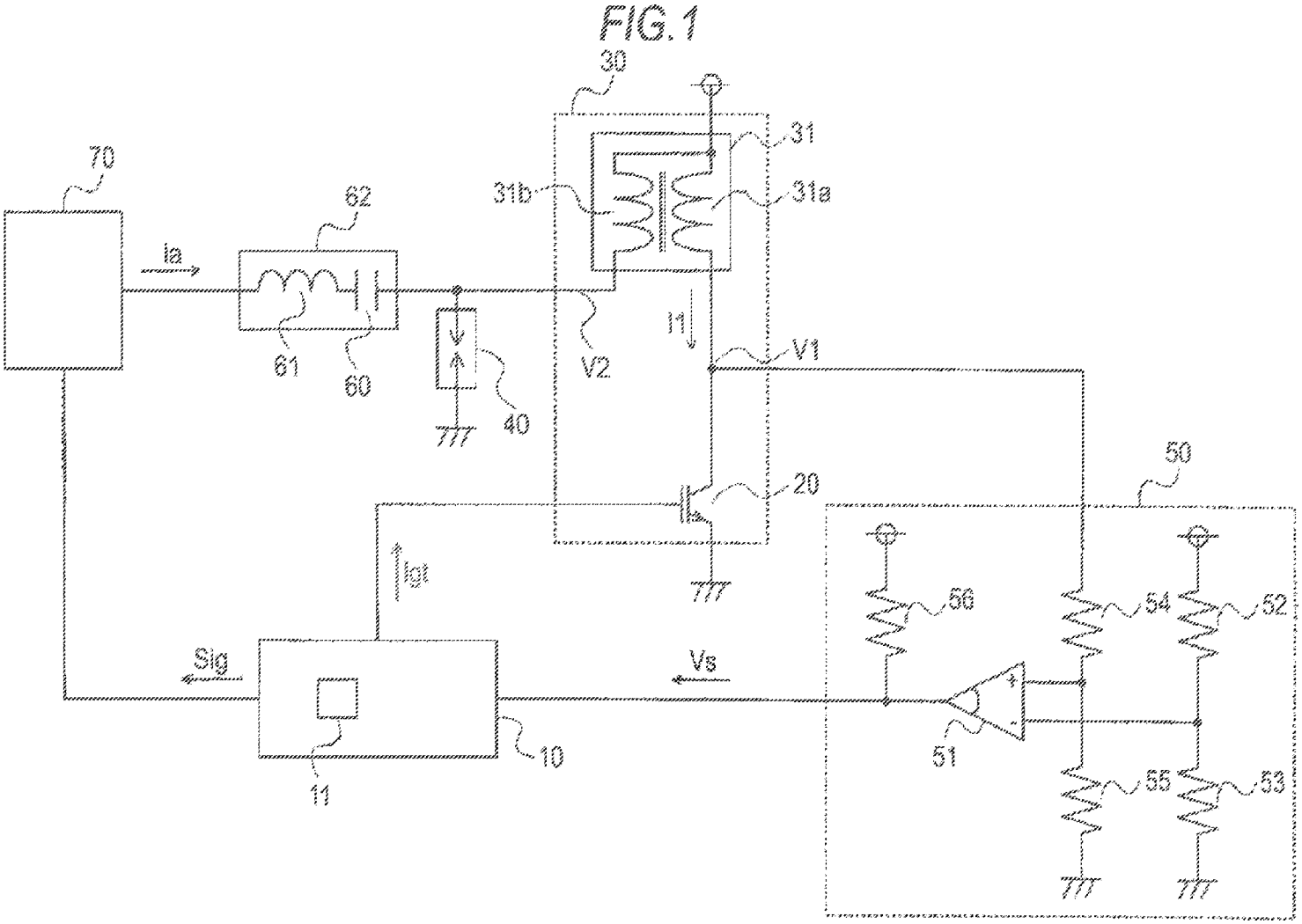
FIG. 1 is a circuit configuration diagram of a high-frequency discharge ignition device according to Embodiment 1 of the present invention.

FIG. 1 is a circuit configuration diagram of the high-frequency discharge ignition device in Embodiment 1, In FIG. 1, the high-frequency discharge ignition device includes an ignition plug 40 which generates spark discharge between electrodes with a gap to ignite a combustible air-fuel mixture in a combustion chamber of an internal combustion engine, an ignition coil device 30 which has an ignition coil unit 31 having a magnetically coupled primary coil 31*a* and secondary coil 31*b*, and a switch element 20 conducting and shutting off a current of the primary coil 31*a* based on a signal Igt from the control device 10, when the switch element 20 is placed in a conduction state, flows a current in the primary coil 31*a* to generate and accumulate a magnetic flux, when the switch element 20 is placed in a shutoff state, generates a predetermined high voltage in the secondary coil 31*b*, and supplies the generated predetermined high voltage tc the ignition plug 40 to form a spark discharge path in the gap of the ignition plug 40, a current supply device 70 which supplies a high-frequency AC current Ia to the spark discharge path formed in the gap of the ignition plug 40, a filter 62 which is provided on the output side of the high-frequency AC current Ia of the current supply device 70, passes the high-frequency AC current Ia to permit the high-frequency AC current Ia to be supplied between the electrodes of the ignition plug 40, and prevents a high voltage when the ignition coil device 30 forms the spark discharge path in the gap of the ignition plug 40 from being applied to the current supply device 70, a control device 10 which controls the operation of the current supply device 70, and a voltage detection device 50 which outputs a signal of a section where a magnetic induction voltage of the primary coil 31*a* generated after the switch element 20 is placed in the shutoff state exceeds a predetermined voltage.

The filter 62 includes a capacitor 60 and an inductor 61 which form a band-pass filter to pass the high-frequency AC current Ia generated by the current supply device 70 to supply the high-frequency AC current Ia between the electrodes of the ignition plug 40 and to prevent a high voltage generated by the secondary coil 31*b* of the ignition coil device 30 to be lower in frequency than the high-frequency AC current Ia or ignition noise generated when the ignition coil device 30 forms the spark discharge path in the gap of the ignition plug 40 from being applied to the current supply device 70. For reference, as an example, the passband of the band-pass filter is about 1 to 4 MHz. The filter 62 may be provided in the current supply device 70.

The current supply device 70 includes, for example, a switching circuit having a half-bridge configuration. Since the band-pass filter having the capacitor 60 and the inductor 61 is disposed on the output side of the current supply device 70, the switching circuit operates a HIGH-side switch and a LOW-side switch of the half bridge to be alternately ON/OFF conforming to the resonance frequency of the band-pass filter.

The switching circuit operates conforming to the resonance frequency of the band-pass filter, whereby impedance of the band-pass filter becomes minimized. For this reason, the high-frequency AC current Ia output from the current supply device 70 becomes maximized. Therefore, the maximum high-frequency AC current Ia is fed into the spark discharge path formed in the gap of the ignition plug 40, thereby forming a large amount of discharge plasma in the gap of the ignition plug 40.

The voltage detection device 50 includes a comparator 51 which detects that a voltage V1 generated by the primary coil 31*a* becomes equal to or greater than a predetermined value and has an open-collector output, voltage-dividing resistors 52 and 53 which generate a comparison reference voltage of the comparator 51, voltage-dividing resistors 54 and 55 which divide the voltage V1 and input the divided voltage to the comparator 51, and a resistor 56 which is connected between the output of the comparator 51 and a power supply.

When the voltage obtained by dividing the voltage V1 with the resistors 54 and 55 exceeds the voltage set by the resistors 52 and 53, the comparator 51 has an output in an open-collector state, and when the voltage obtained by dividing the voltage V1 with the resistors 54 and 55 falls below the voltage set by the resistors 52 and 53, the comparator 51 has an output at GND level. For this reason, an output signal Vs of the voltage detection device outputs a signal at high level from the power supply through the resistor 56 when the voltage V1 exceeds the voltage set by the resistors 52 and 53, and outputs a signal at low level when the voltage V1 falls below the voltage set by the resistors 52 and 53.

The control device 10 includes a microcomputer 11, and the microcomputer 11 measures the timing when the signal Vs output from the voltage detection device 50 changes from the high level to the low level, thereby determining the timing when the spark discharge path has been formed in the gap of the ignition plug 40.

The microcomputer 11 measures the time width where the signal Vs output from the voltage detection device 50 is at high level, thereby determining the discharge voltage of the ignition plug 40.

Figure 2:
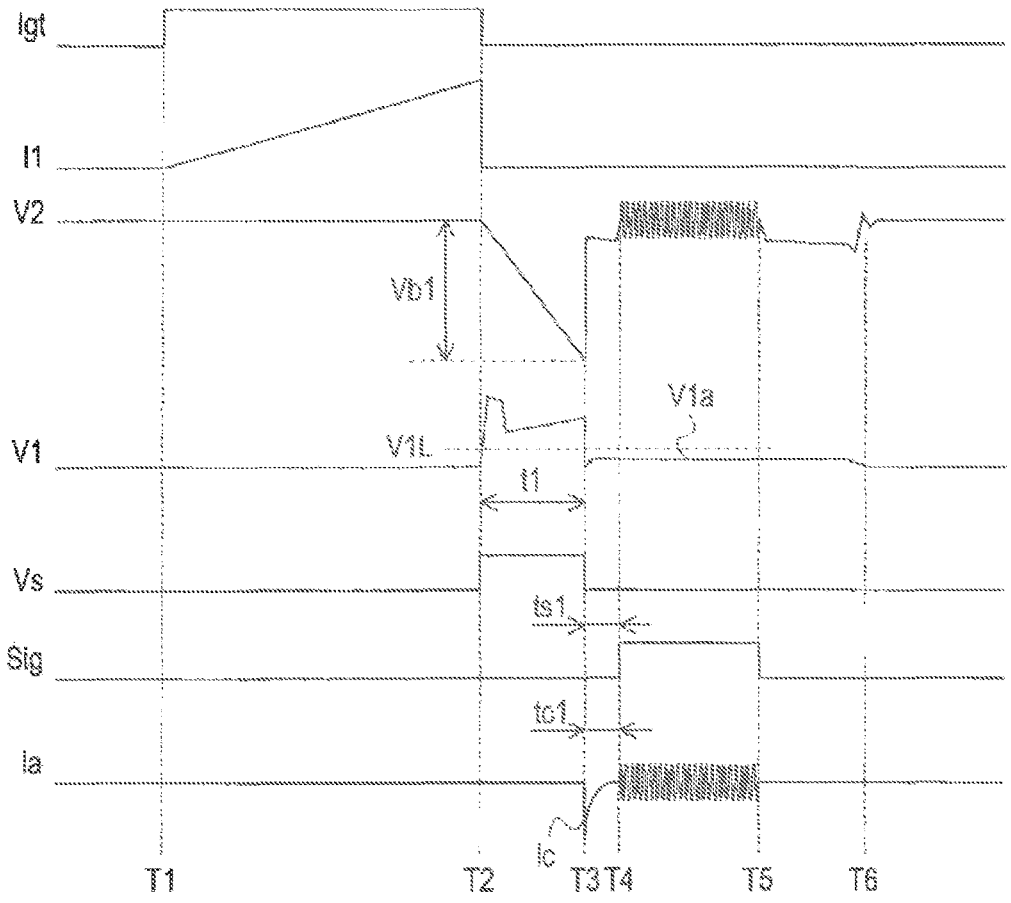
FIG. 2 is a timing chart showing the operation of the high-frequency discharge ignition device according to Embodiment 1 of the present invention.

FIG. 2 is a timing chart of the operation of the high-frequency discharge ignition device of Embodiment 1, At a time point T1, if the signal Igt from the control device 10 becomes a high level, the switch element 20 is placed in a conduction state, and a current I1 starts to flow in the primary coil 31*a*.

At a time point T2, if the signal Igt from the control device 10 changes to a low level, the switch element 20 is placed in a shutoff state, the current I1 flowing in the primary coil 31*a* is shut off, rapid change in coil magnetic flux is generated, and a voltage V1 and a voltage V2 are respectively generated in the primary coil 31*a* and the secondary coil 31*b* by electromagnetic induction. An induction current starts to flow in the secondary coil 31*b*, a ground capacitor latent in the ignition plug 40 and the capacitor 60 are charged, the voltage V2 becomes a voltage which gradually increases from the time point T2, and the voltage V1 becomes a voltage which has a high peak voltage generated immediately after the time point T2 and thereafter gradually increases. The high peak voltage of the voltage V1 immediately after the time point T2 is a surge voltage which is generated by primary coil leakage inductance when the primary coil 31*a* and the secondary coil 31*b* are not magnetically coupled 100%. The voltage which gradually increases subsequent to the surge voltage is a voltage which is generated by a transformer having a winding number ratio N of the primary coil 31*a* and the secondary coil 31*b*, and becomes V1=V2/N.

The voltage detection device 50 detects a predetermined value V1L set by the resistors 52, 53, 54, and 55, and if the voltage V1 exceeds the predetermined value V1L, the output of the comparator 51 is placed in the open-collector state, and the output signal Vs becomes the high level.

The microcomputer 11 measures the time ta1 of the timing when the signal Vs output from the voltage detection device 50 changes from the low level to the high level.

At a time point T3, if the generated voltage V2 exceeds an insulation withstand voltage Vb1 of the gap of the ignition plug 40, the spark discharge path is formed in the gap, and the voltage V2 rapidly decreases to a glow/arc discharge voltage. Accordingly, the voltage V1 rapidly decreases and becomes a voltage Via which falls below the predetermined value V1L. If the voltage V1 falls below the predetermined value V1L, the output signal Vs of the voltage detection device 50 becomes the low level.

The microcomputer 11 measures the time ta2 of the timing when the signal Vs output from the voltage detection device 50 changes from the high level to the low level, thereby determining the timing when the spark discharge path has been formed in the gap of the ignition plug 40.

The microcomputer 11 measures a time width t1 at high level from the time ta1 to the time ta2, thereby determining the discharge state of the ignition plug 40.

The predetermined value V1L is lower than the voltage V1 in the period of the time width t1 and higher than the voltage Via during the glow/arc discharge period, and is set to, for example, about 100 V.

A capacitive current Ic by discharge of an electric charge accumulated in the ground capacitor latent in the ignition plug 40 and the capacitor 60 starts to flow from the capacitor 60 toward the current supply device 70, and ends at substantially zero amperes after a time width tc1.

After a set time ts1 has elapsed based on the timing ta1 determined by the microcomputer 11 when the spark discharge path has been formed in the gap of the ignition plug 40, at a time point T4, the control device 10 changes a signal Sig to a high level to operate the current supply device 70.

The current supply device 70 supplies the AC current Ia to the spark discharge path formed in the gap of the ignition plug 40, thereby forming discharge plasma in the gap of the ignition plug 40. The voltage V2 becomes a positive/negative glow/arc discharge voltage centering on zero volts by the AC current Ia.

At a time point T5, the control device 10 changes the signal Sig to a low level to stop the operation of the current supply device 70. The current supply device 70 stops the supply of the AC current Ia, whereby the AC current Ia is ended at substantially zero amperes and discharge plasma formed in the gap of the ignition plug 40 stops. Similarly to the time point T3, the voltage V2 becomes a glow/arc discharge voltage.

At a time point T6, if spark discharge by the ignition coil device 30 ends, the voltage V2 and the voltage V1 are ended at substantially zero volts.

Figure 3:
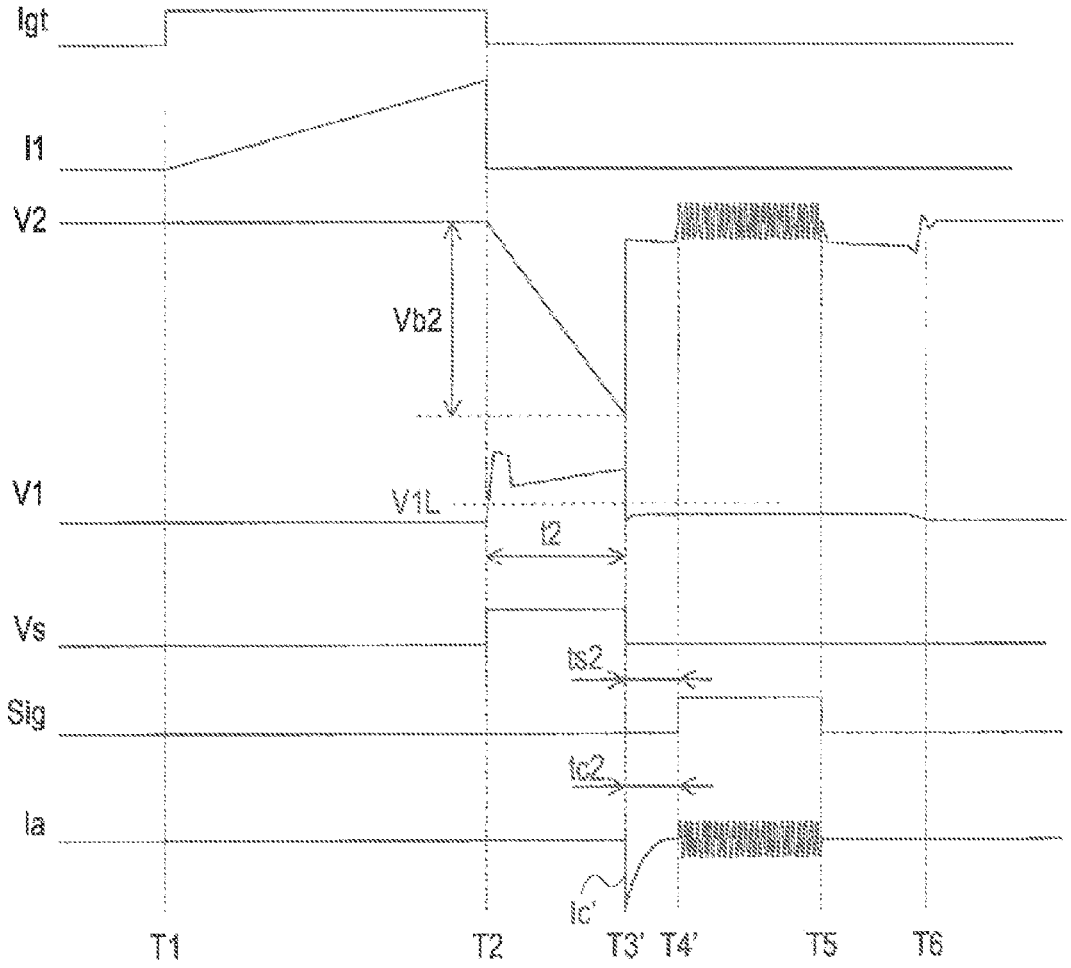
FIG. 3 is a timing chart of the operation of the high-frequency discharge ignition device according to Embodiment 1 of the present invention at a voltage Vb different from that in FIG. 2.

Next, FIG. 3 is a timing chart of the operation of the high-frequency discharge ignition device in Embodiment 1 when the insulation withstand voltage of the gap of the ignition plug 40 is different from that in FIG. 2.

The description of the time points T1, T2, T5, and T6 is the same as that in FIG. 2, and thus will not be repeated. At a time point T3', if the generated voltage V2 exceeds an insulation withstand voltage Vb2 of the gap of the ignition plug 40, the spark discharge path is formed in the gap, and the voltage V2 rapidly decreases to a glow/arc discharge voltage. Since the insulation withstand voltage Vb2 of FIG. 3 is higher toward the negative side than the insulation withstand voltage Vb1 of FIG. 2, a time width t2 becomes longer than the time width t1 of FIG. 2 accordingly. Since a capacitive current Ic' increases with an increase in the voltage V2, a time width tc2 becomes longer than the time width tc1 of FIG. 2.

At a time point T4', the control device 10 changes the signal Sig to the high level, thereby operating the current supply device 70. The current supply device 70 supplies the AC current Ia to the spark discharge path formed in the gap of the ignition plug 40, thereby forming discharge plasma in the gap of the ignition plug 40. The voltage V2 becomes a positive/negative glow/arc discharge voltage centering on zero volts by the AC current Ia.

Figure 4:
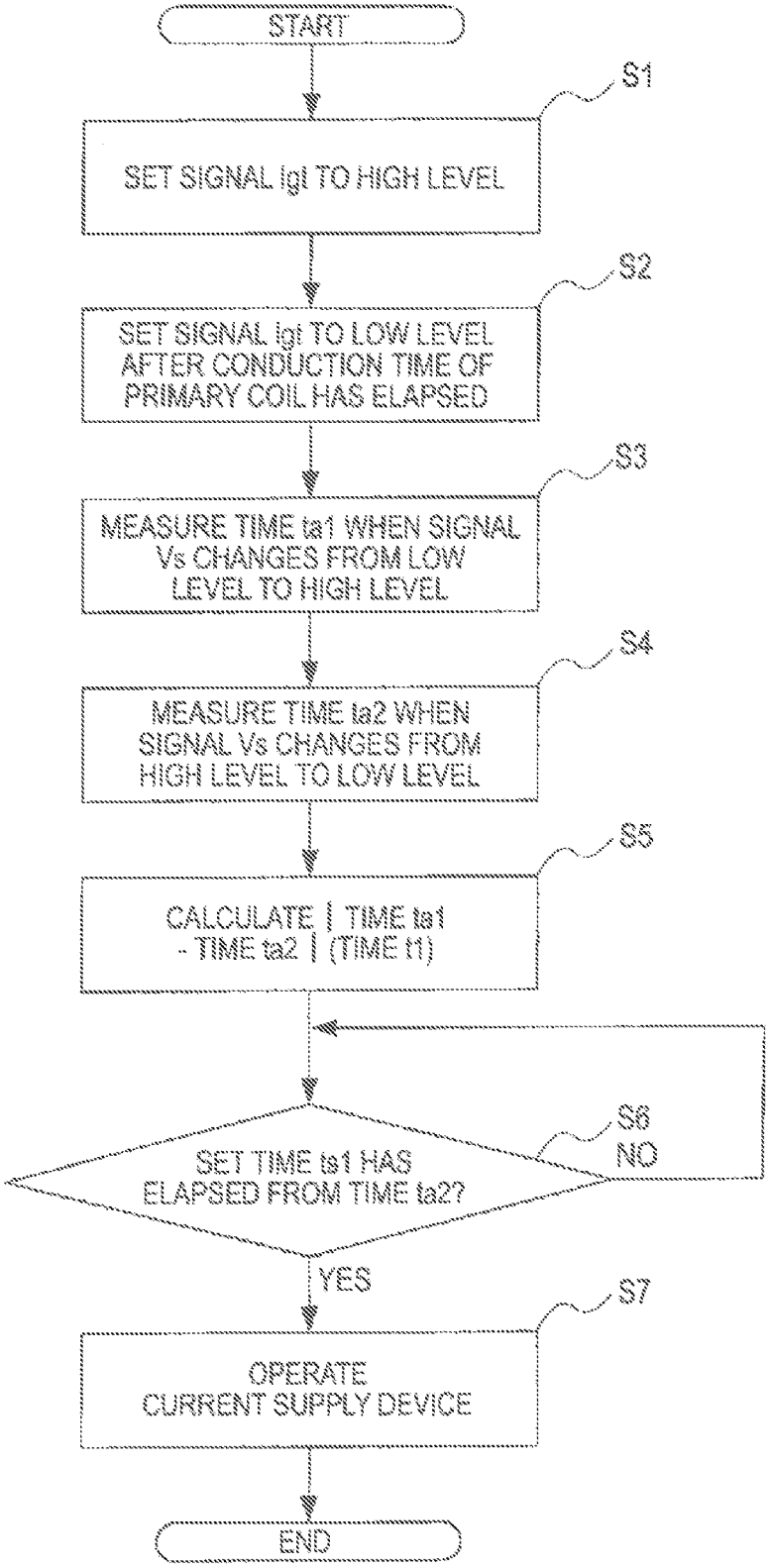
FIG. 4 is a flowchart showing a control procedure of the high-frequency discharge ignition device according to Embodiment 1 of the present invention.

FIG. 4 is a flowchart of a control procedure of the high-frequency discharge ignition device of Embodiment 1.

Referring to FIG. 4, in Step S1, the control device 10 sets the signal Igt to the high level.

In Step S2, the control device 10 sets the signal Igt to the low level after the conduction time of the primary coil 31*a* has elapsed from Step S1.

In Step S3, the microcomputer 11 measures the time ta1 of the timing when the signal Vs output from the voltage detection device 50 changes from the low level to the high level.

In Step S4, the microcomputer 11 measures the time ta2 of the timing when the signal Vs output from the voltage detection device 50 changes from the high level to the low level.

In Step S5, the microcomputer 11 measures the time width t1 from the time ta1 to the time ta2.

In Step S6, the control device 10 waits until the set time ts1 elapses from the time ta2.

In Step S7, when the determination condition is established in Step S6, the control device 10 operates the current supply device 70.

Figure 5:
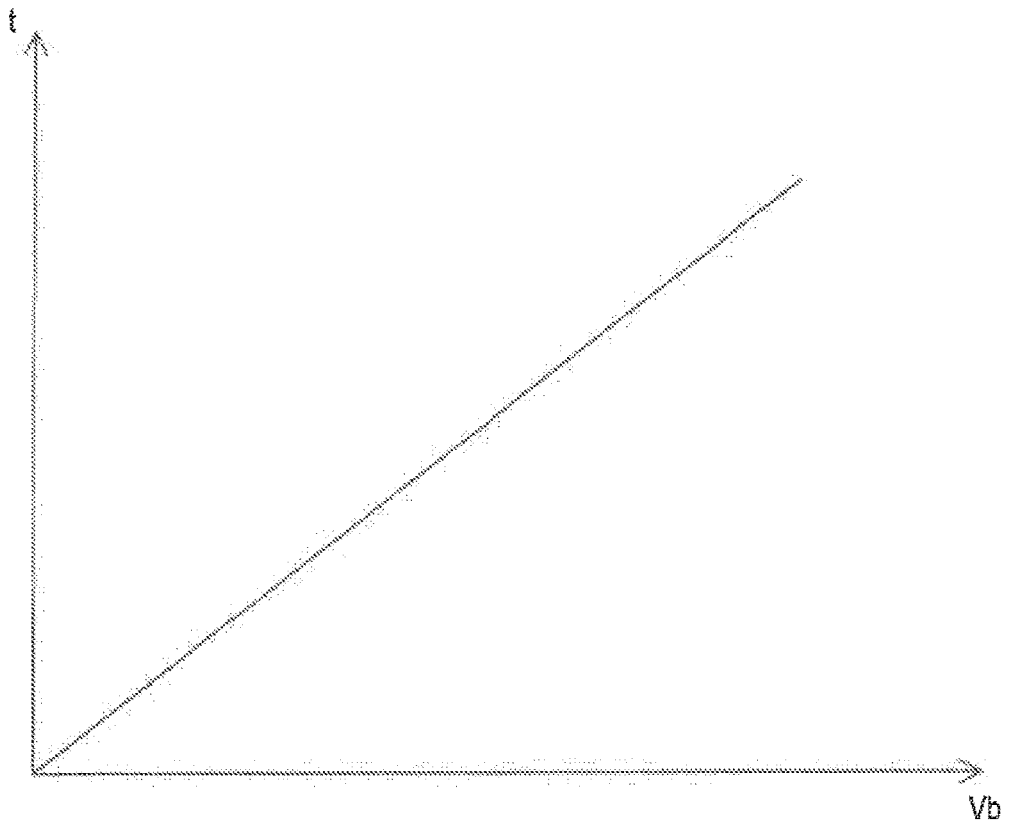
FIG. 5 is a graph showing the relationship between the voltage Vb and the time t in the high-frequency discharge ignition device according to Embodiment 1 of the present invention.

The set time ts1 may be a map value or a computational value which is set depending on operation conditions, the discharge state, or the like. The set time ts1 determined according to the determination result of the discharge voltage of the ignition plug. FIG. 5 is a diagram showing the relationship between the voltage Vb where dielectric breakdown occurs in the gap of the ignition plug 40 and the spark discharge path is formed and the time t when the voltage V1 exceeds the predetermined value V1L.

From FIG. 5, the time t when the voltage V1 exceeds the predetermined value V1L is proportional to the voltage Vb where the spark discharge path is formed in the gap of the ignition plug 40. The longer the time t when the voltage V1 exceeds the predetermined value V1L, the higher the voltage Vb where dielectric breakdown occurs in the gap of the ignition plug 40 and the spark discharge path is formed. From this, the time t when the voltage V1 exceeds the predetermined value V1L is measured, thereby determining the voltage Vb where dielectric breakdown occurs in the gap of the ignition plug 40 and the spark discharge path is formed.

Figure 6:
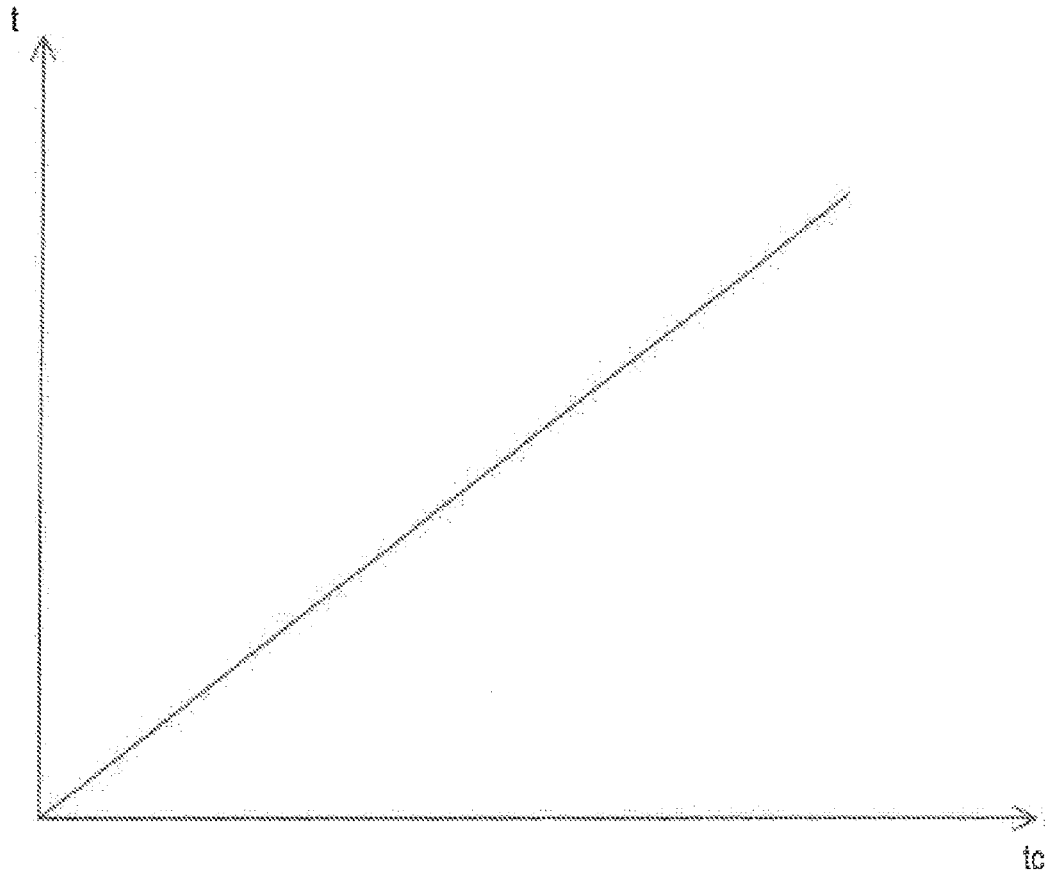
FIG. 6 is a graph showing the relationship between the time tc and the time t in the high-frequency discharge ignition device according to Embodiment 1 of the present invention.

FIG. 6 is a diagram showing the relationship between the time tc when the capacitive current Ic flows and the time t when the voltage V1 exceeds the predetermined value V1L. In FIG. 6, the time t when the voltage V1 exceeds the predetermined value V1L is proportional to the time to when the capacitive current Ic flows. The longer the time t when the voltage V1 exceeds the predetermined value V1L, the longer the time tc when the capacitive current Ic flows.

From this, the time t when the voltage V1 exceeds the predetermined value V1L is measured, thereby determining the voltage Vb where dielectric breakdown occurs in the gap of the ignition plug 40 and the spark discharge path is formed and determining the time to when the capacitive current Ic flows with change according to the voltage Vb where dielectric breakdown occurs in the gap of the ignition plug 40 and the spark discharge path is formed. The set time ts1 is set to be equal to or longer than the time tc when the capacitive current Ic flows, thereby avoiding a risk of breakdown of the current supply device 70 by the capacitive current Ic when the current supply device 70 is operated in a period during which the capacitive current Ic flows.

In this way, in Embodiment 1, the time t when the voltage V1 exceeds the predetermined value V1L and the time tc when the capacitive current Ic flows change according to the voltage Vb where dielectric breakdown occurs in the gap of the ignition plug 40 and the spark discharge path is formed. The time t when the voltage V1 exceeds the predetermined value V1L is measured, thereby determining the timing when dielectric breakdown occurs in the gap of the ignition plug 40 and the spark discharge path is formed and determining the discharge voltage of the ignition plug 40.

After an appropriate set time for determining the discharge voltage of the ignition plug 40 has elapsed determined from the timing when dielectric breakdown occurs in the gap of the ignition plug 40 and the spark discharge path is formed, the current supply device which supplies the AC current to the spark discharge path formed in the gap of the ignition plug can be operated, and the AC current can be supplied to the spark discharge path. For this reason, it is possible to efficiently form discharge plasma.

An element capable of withstanding a high voltage is not required, a component and wiring to the high voltage side are not required, and only wiring to the primary coil side of a low voltage is provided, whereby it is possible to realize a voltage detection device by a general-purpose component for a low voltage and there are less problems in terms of cost.

Embodiment 2

Figure 7:
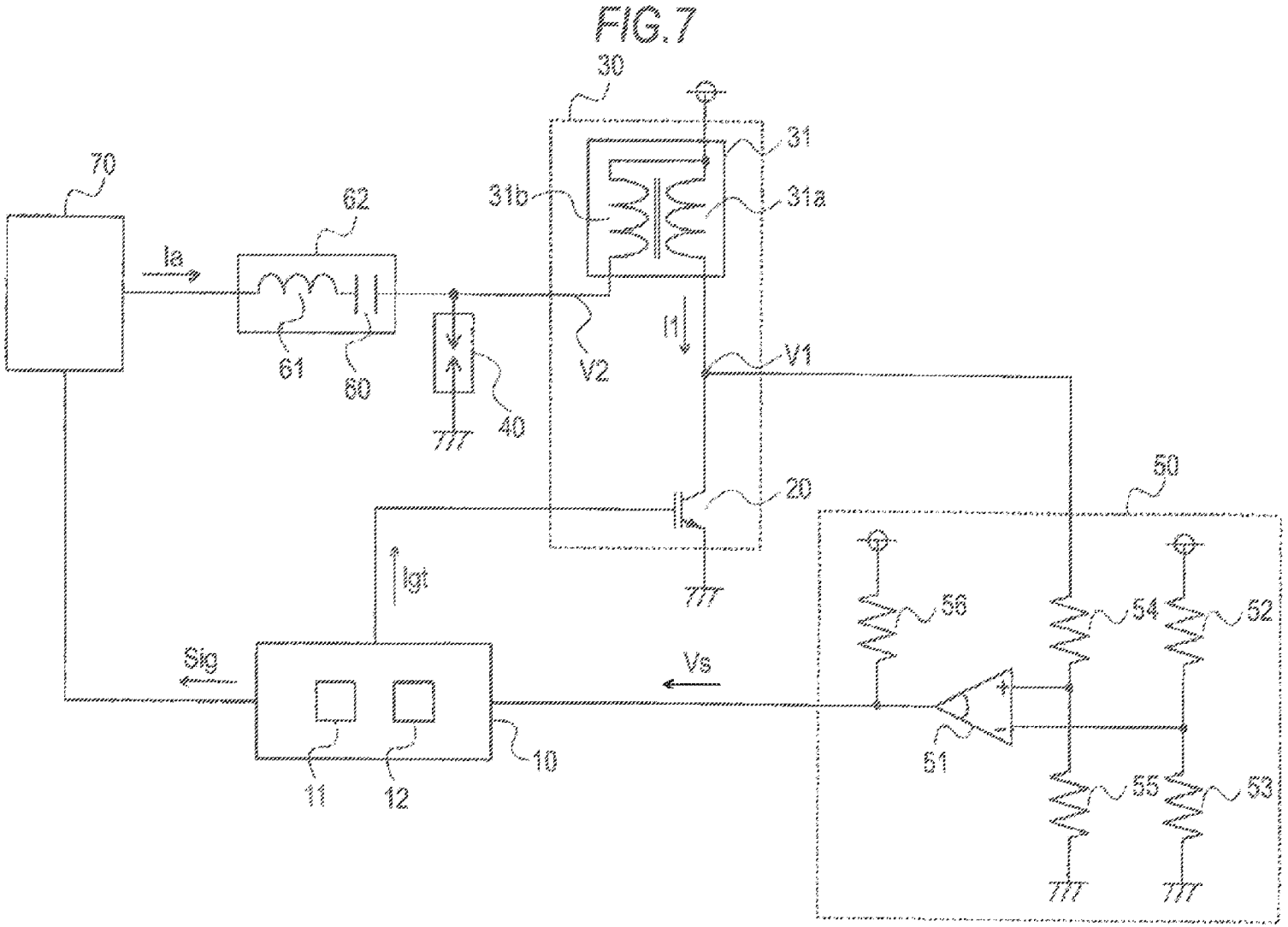
FIG. 7 is a circuit configuration diagram of a high-frequency discharge ignition device according to Embodiment 2 of the present invention.

FIG. 7 is a circuit configuration diagram of a high-frequency discharge ignition device of Embodiment 2.

The high-frequency discharge ignition device of Embodiment 2 further includes an ignition plug state determination device which determines an abnormal state of the ignition plug 40, with respect to the configuration of Embodiment 1.

An ignition plug state determination device 12 stops the operation of the current supply device 70 according to the determination result of the discharge voltage of the ignition plug 40 determined by the microcomputer 11.

Figure 8:
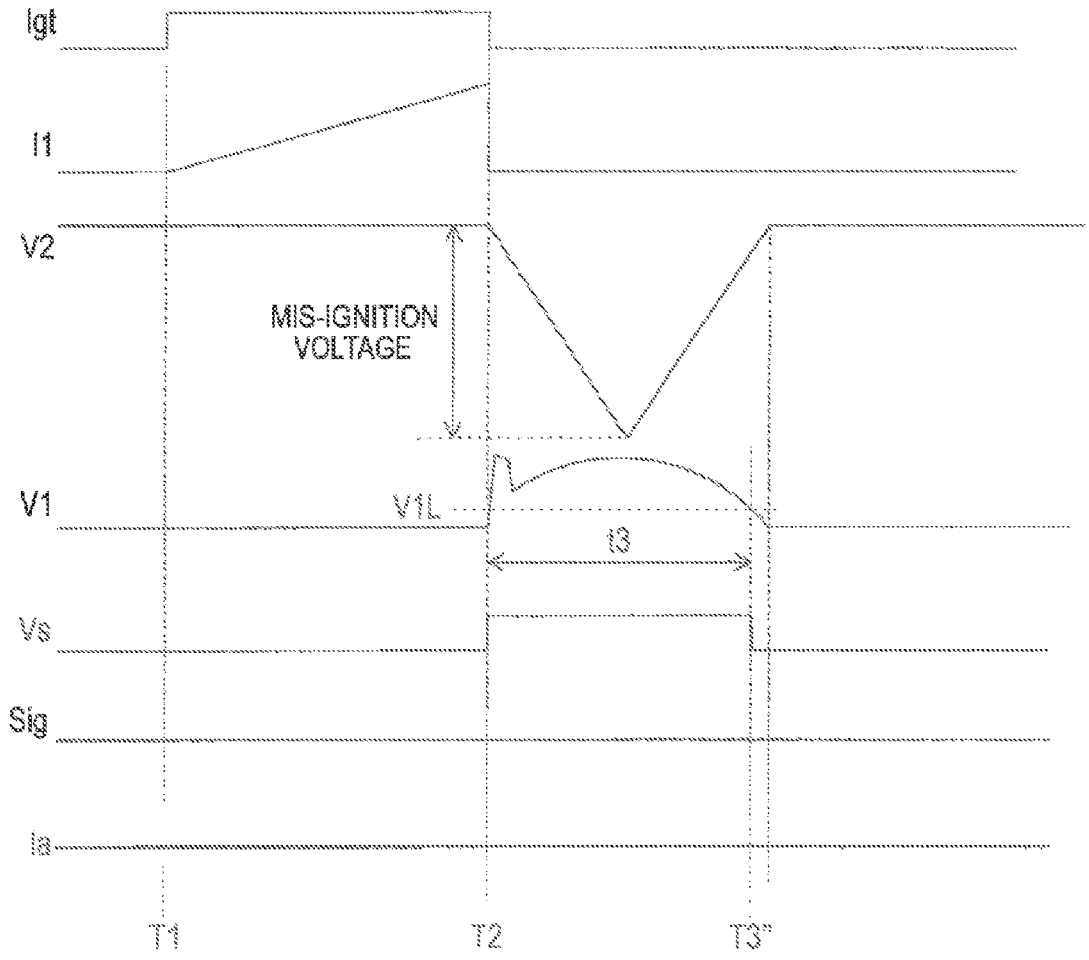
FIG. 8 is a timing chart at the time of misfire in the operation of the high-frequency discharge ignition device according to Embodiment 2 of the present invention.

Next, FIG. 8 is a timing chart of the operation of the high-frequency discharge ignition device in Embodiment 2 when dielectric breakdown does not occur in the gap of the ignition plug 40 and the gap of the ignition plug 40 is placed in a misfire state.

The time points T1 and T2 are the same as those in Fi 2, thus description thereof will be omitted.

At a time point T3", since the generated voltage V2 does not exceed the insulation withstand voltage of the gap of the ignition plug 40 and no spark discharge path is formed, the voltage V2 and the voltage V1 do not undergo a rapid voltage drop and have a peak-shaped waveform with a gentle slope, and the time t3 when the voltage V1 exceeds the predetermined value V1L becomes longer than the time t1 of FIG. 2 or the time t2 of FIG. 3.

From the time t3, it is determined that the state of the ignition plug is abnormal, and the control device 10 stops the operation of the current supply device while maintaining the signal Sig at low level.

Figure 9:
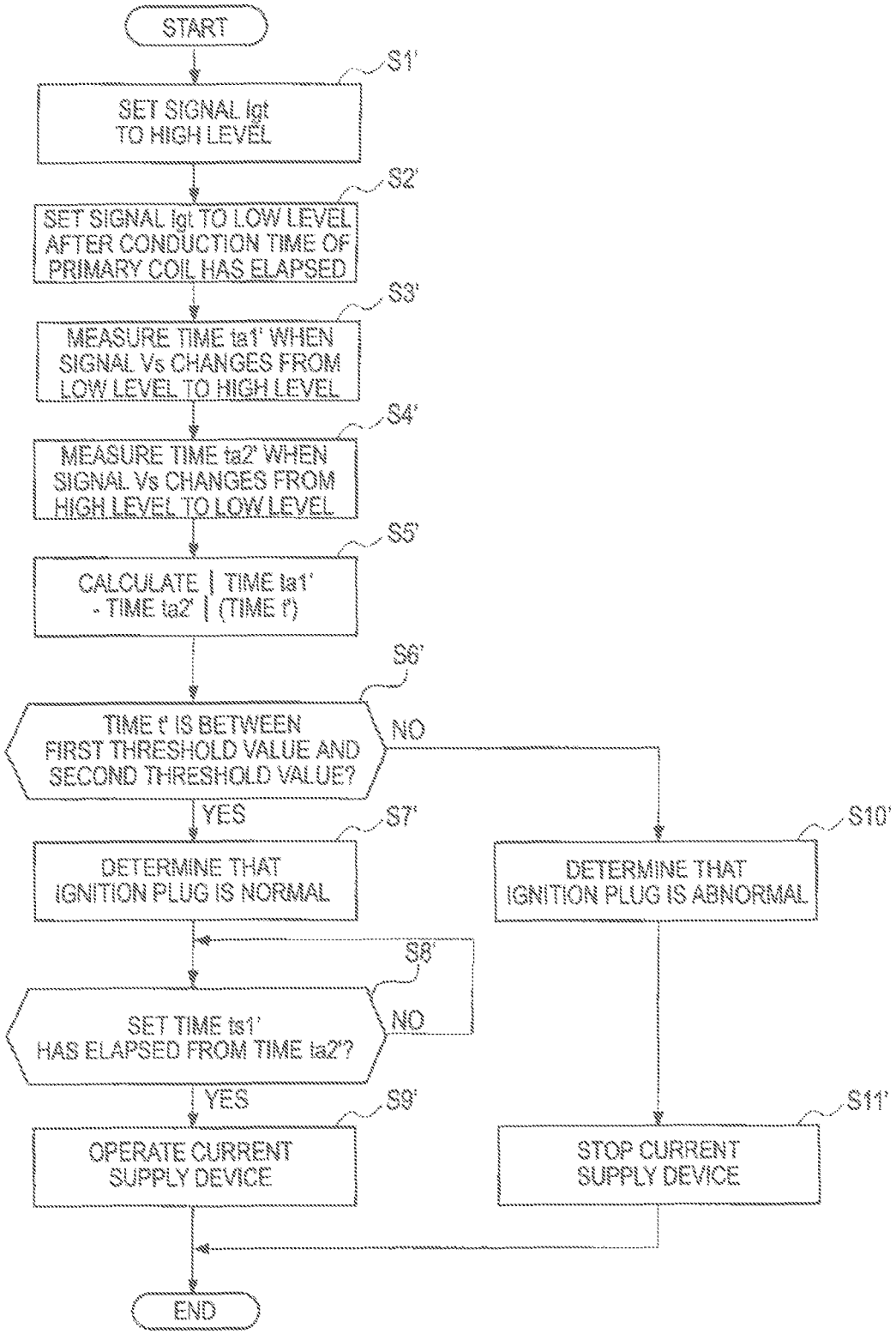
FIG. 9 is a flowchart showing a control procedure of the high-frequency discharge ignition device according to Embodiment 2 of the present invention.

FIG. 9 is a flowchart of a control procedure of the high-frequency discharge ignition device in Embodiment 1.

Referring to FIG. 9, in Step S1', the control device 10 sets the signal Igt to the high level.

In Step S2', the control device 10 sets the signal Igt to the low level after the conduction time of the primary coil 31*a* has elapsed from Step S1'.

In Step S3', the microcomputer 11 measures the time ta1' of the timing when the output signal Vs of the voltage detection device 50 changes from the low level to the high level.

In Step S4', the microcomputer 11 measures the time ta2' of the timing when the output signal Vs of the voltage detection device 50 changes from the high level to the low level.

In Step S5', the microcomputer 11 measures a time width t' from the time ta1' to the time ta2'.

In Step S6', the ignition plug state determination device 12 determines whether or not the time width t' is between a first threshold value and a second threshold value.

In Step S7', when the time width t' satisfies the determination condition in Step S6', it is determined that the ignition plug is normal.

In Step S8', the control device 10 waits until the set time ts1' elapses from the time ta2'.

In Step S9', when the determination condition is satisfied in Step S8', the control device 10 operates the current supply device 70.

In Step S10', when the time width t' does not satisfy the determination condition in Step S6', it is determined that the ignition plug is abnormal.

In Step S11', the control device 10 stops the operation of the current supply device 70.

Figure 10:
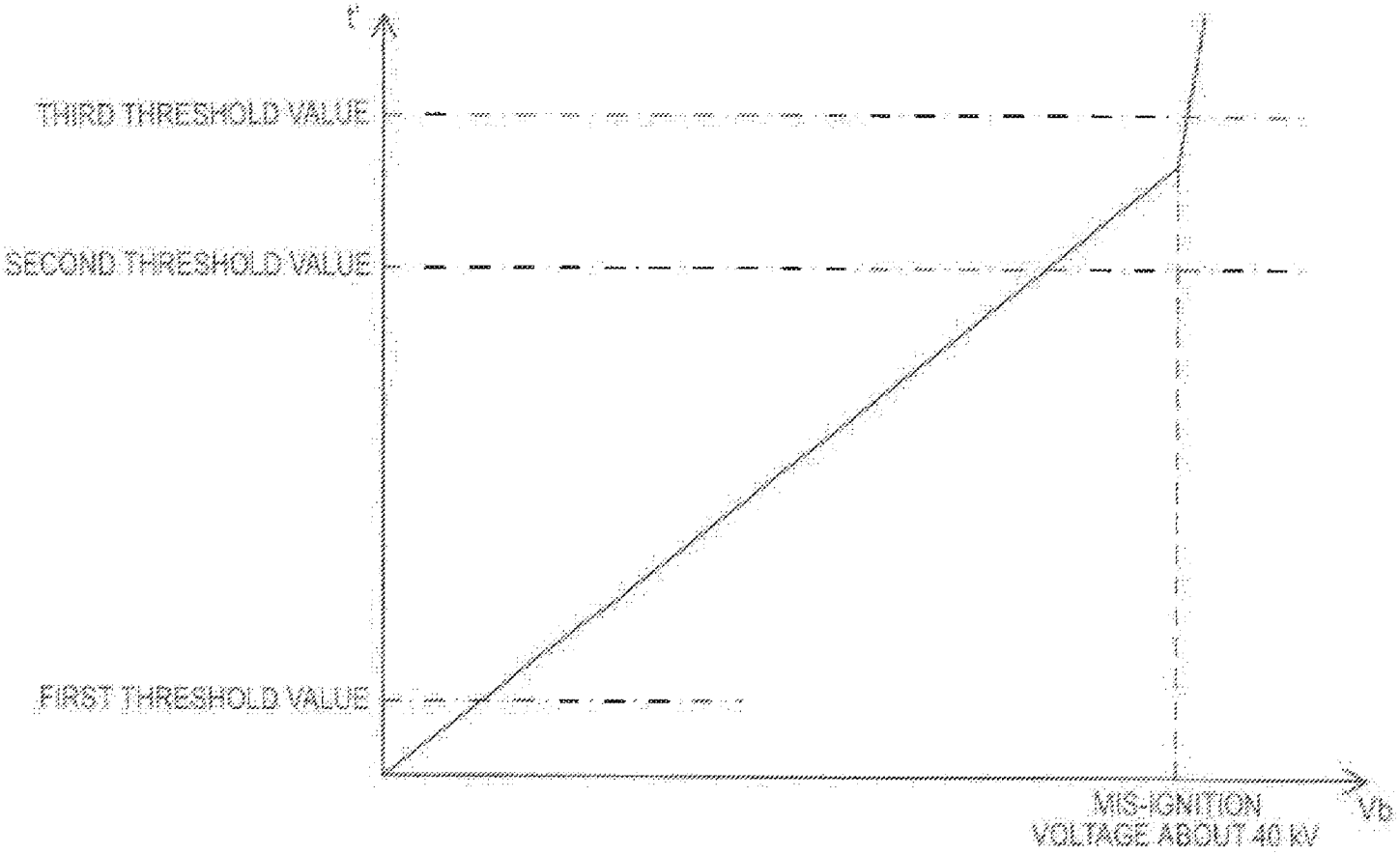
FIG. 10 is a graph showing the relationship between the voltage Vb and the time t in the high-frequency discharge ignition device according to Embodiment 2 of the present invention.

FIG. 10 is a diagram showing the relationship between the voltage Vb where dielectric breakdown occurs in the gap of the ignition plug 40 and the spark discharge is generated and the time t' when the voltage V1 exceeds the predetermined value V1L.

In FIG. 10, if the time t' is equal to or less than the first threshold value, it can be determined that leakage discharge is likely to occur at a place other than the gap of the ignition plug 40. If the time t' is equal to or greater than the second threshold value, it can be determined that the discharge voltage becomes abnormally high by electrode wear of the ignition plug 40. If the time t' is equal to or greater than the third threshold value, it can be determined that dielectric breakdown does not occur in the ignition plug 40 and misfire occurs.

In this way, in Embodiment 2, the time t' when the voltage V1 exceeds the predetermined value V1L is measured, whereby the control device 10 can determine the state of the ignition plug 40 and can use the result in determining operation permission or stop of the current supply device 70, or the timing for permitting the operation. The control device 10 may display the state of the ignition plug using, for example, an external warning or the like for warning a driver, and may stop fuel injection being controlled by an ECU or the like to prevent non-combusted gasoline from being emitted outside the internal combustion engine.

The high-frequency discharge ignition device according to the present invention is mounted in an automobile, a two-wheeled vehicle, an outboard motor, other special machines, and the like using an internal combustion engine, and allows reliable ignition to fuel. For this reason, it is possible to efficiently operate an internal combustion engine, thereby contributing to solving the fuel depletion problem and environmental conservation.

Incidentally, the present invention is such that it is possible to combine the embodiments and appropriately modify or omit each or either of the embodiments without departing from the scope of the present invention.

In the respective drawings, the same reference numerals represent the same or similar portions.

Various modifications and alterations of the present invention will be apparent to those skilled in the art without departing from the scope and spirit of the present invention, and it should be understood that this is not limited to the illustrative embodiments set forth herein.

What is claimed is:

1. A high-frequency discharge ignition device comprising:

an ignition coil device which has an ignition coil unit having a magnetically coupled primary coil and secondary coil, and a switch element conducting the current of the primary coil and shutting off the current after the conduction, when the switch element is placed in a conduction state, flows a current in the primary coil to generate and accumulate a magnetic flux, when the switch element is placed in a shutoff state, generates a predetermined high voltage in the secondary coil, and supplies the generated predetermined high voltage to an ignition plug, which generates a spark discharge between electrodes with a gap to ignite a combustible air-fuel mixture in a combustion chamber of an internal combustion engine, to form a spark discharge path in the gap;

a current supply device which supplies a high-frequency AC current to the spark discharge path formed in the gap of the ignition plug;

a filter which is provided on the output side of the high-frequency AC current of the current supply device, passes the high-frequency AC current to permit the high-frequency AC current to be supplied between the electrodes of the ignition plug, and prevents the high voltage far forming the spark discharge path from being applied to the current supply device;

a control device which controls the operation of the current supply device; and a voltage detection device which outputs a signal of a section where a magnetic induction voltage of the primary coil generated after the switch element is placed in a shutoff state exceeds a predetermined voltage, wherein the control device determines the timing when the spark discharge path has been formed in the gap of the ignition plug according to an output signal of the voltage detection device and operates the current supply device based on the timing when the spark discharge path has been formed in the gap of the ignition plug to supply the high-frequency AC current to the spark discharge path.

2. The high-frequency discharge ignition device according to claim 1, wherein, after a predetermined set time has elapsed from the timing when the spark discharge path has been formed, the control device operates the current supply device, which supplies the high-frequency AC current to the spark discharge path formed in the gap of the ignition plug, to supply the high-frequency AC current to the spark discharge path.

3. The high-frequency discharge ignition device according to claim 2, wherein the set time is a map value according to an operation state.

4. The high-frequency discharge ignition device according to claim 2, wherein the set time is determined according to the determination result of a discharge voltage of the ignition plug.

5. The high-frequency discharge ignition device according to claim 1, wherein the control device includes an ignition plug state determination device which determines an abnormal state of the ignition plug according to a determination result of a discharge voltage of the ignition plug, and when the ignition plug state determination device determines that the ignition plug is in the abnormal state, stops the operation of the current supply device.

6. The high-frequency discharge ignition device according to claim 2, wherein the control device includes an ignition plug state determination device which determines an abnormal state of the ignition plug according to a determination result of a discharge voltage of the ignition plug, and when the ignition plug state determination device determines that the ignition plug is in the abnormal state, stops the operation of the current supply device.

7. The high-frequency discharge ignition device according to claim 3, wherein the control device includes an ignition plug state determination device which determines an abnormal state of the ignition plug according to a determination result of a discharge voltage of the ignition plug, and when the ignition plug state determination device determines that the ignition plug is in the abnormal state, stops the operation of the current supply device.

8. The high-frequency discharge ignition device according to claim 4, wherein the control device includes an ignition plug state determination device which determines an abnormal state of the ignition plug according to a determination result of a discharge voltage of the ignition plug, and when the ignition plug state determination device determines that the ignition plug is in the abnormal state, stops the operation of the current supply device.

* * * * *